US009551172B2

(12) United States Patent
Barmscheidt et al.

(10) Patent No.: US 9,551,172 B2
(45) Date of Patent: Jan. 24, 2017

(54) MOTOR-VEHICLE DOOR LOCK

(71) Applicant: Kiekert Aktiengesellschaft, Heiligenhaus (DE)

(72) Inventors: Christian Barmscheidt, Duisburg (DE); Alexander Grossmann, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 131 days.

(21) Appl. No.: 14/381,661

(22) PCT Filed: Feb. 26, 2013

(86) PCT No.: PCT/DE2013/000103

§ 371 (c)(1),
(2) Date: Aug. 28, 2014

(87) PCT Pub. No.: WO2013/127382

PCT Pub. Date: Sep. 6, 2013

(65) Prior Publication Data

US 2015/0021934 A1 Jan. 22, 2015

(30) Foreign Application Priority Data

Feb. 28, 2012 (DE) ..... 10 2012 003 743

(51) Int. Cl.

| | |
|---|---|
| ***E05B 3/00*** | (2006.01) |
| ***E05B 85/00*** | (2014.01) |
| ***E05B 77/04*** | (2014.01) |
| ***E05B 81/90*** | (2014.01) |
| ***E05B 81/00*** | (2014.01) |
| *E05B 81/14* | (2014.01) |

(52) U.S. Cl.

CPC ..... *E05B 85/00* (2013.01); *E05B 77/04* (2013.01); *E05B 81/00* (2013.01); *E05B 81/90* (2013.01); *E05B 81/14* (2013.01); *Y10T 292/57* (2015.04)

(58) Field of Classification Search

CPC .. Y10T 292/1082; E05B 81/00; Y10S 292/23; Y10S 292/65

USPC ..... 292/336.3, 216, 201, DIG. 23

See application file for complete search history.

(56) References Cited

U.S. PATENT DOCUMENTS

2002/0096889 A1 7/2002 Nelsen et al.
2002/0167177 A1* 11/2002 Erices ..... E05B 77/04 292/201

(Continued)

FOREIGN PATENT DOCUMENTS

DE 695 11 357 T3 5/2005
DE 100 48 709 A1 11/2005

(Continued)

*Primary Examiner* — Mark Williams

(74) *Attorney, Agent, or Firm* — Renner, Otto, Boisselle & Sklar, LLP

(57) ABSTRACT

The invention relates to a motor vehicle door lock comprising a locking mechanism, at least one locking lever (3) and an electric drive (5, 6, 7) for the locking mechanism. In normal operation, said electric drive (5, 6, 7) acts upon the locking mechanism for an electric opening. Additionally, the electric drive (5, 6, 7) allows the locking mechanism to be mechanically opened at least for an emergency operation. According to the invention, said locking lever (3) remains, in the normal operation, in the 'locked' position, also when opened electrically.

15 Claims, 3 Drawing Sheets

(56) References Cited

U.S. PATENT DOCUMENTS

| | | | | |
|---|---|---|---|---|
| 2003/0116977 | A1* | 6/2003 | Erices | E05B 81/06 292/201 |
| 2005/0093685 | A1* | 5/2005 | Kachouh | B60N 2/0244 340/438 |
| 2015/0021934 | A1* | 1/2015 | Barmscheidt | E05B 77/04 292/336.3 |

FOREIGN PATENT DOCUMENTS

| | | | |
|---|---|---|---|
| EP | 0 710 755 | A1 | 5/1996 |
| EP | 1 320 652 | B1 | 11/2005 |
| EP | 1 225 290 | B1 | 7/2006 |

* cited by examiner

MOTOR-VEHICLE DOOR LOCK

The invention relates to a motor vehicle door lock comprising a locking mechanism, at least one locking lever and an electric drive for the locking mechanism with the electric drive acting upon the locking mechanism during normal operation for electric opening and also provides a mechanical opening of the locking mechanism at least during emergency operation.

In a motor vehicle door lock of the described design as disclosed in EP 1 320 652 B1, the electric drive not only provides the electric opening of the locking mechanism. Instead, the electric drive ensures that, for instance, during emergency operation, this means in the event of an emergency opening, an external actuating lever is mechanically connected to the pawl and/or rotary latch as components of the locking mechanism. In order to achieve this, an intermediate lever controllable by the electric drive is provided. During emergency opening or during emergency operation, the intermediate lever couples a triggering lever, acted upon by the external actuating lever with the aid of a through journal, to the pawl. As a result, the external actuating lever can directly mechanically disengage the pawl during emergency opening or emergency operation. This ensures an overall reliably functioning operation whilst using a simple and cost effective design.

When electrically opening a motor vehicle door, a handle, such as an external and/or an internal actuating lever is typically not mechanically connected to the, locking mechanism. During normal operation it is instead a sensor acted upon by the respective handle that ensures that the electric drive is energized in order to be able to open the locking mechanism with the aid of a motor rather than manually. This reduces required operating forces and ensures a reliable opening of the locking mechanism. This has generally proven to be successful.

Apart from the standard operation this method also covers an emergency operation or a so-called emergency opening. Such an emergency operation occurs, for instance, when the electric drive no longer works reliably or has ceased to work due to a drop in voltage in the car battery. The emergency operation typically also occurs when directly after an accident failure of the electric drive can or must be anticipated. In this context the emergency operation ensures that the locking mechanism can be mechanically opened. This means that at least during an emergency operation a mechanical connection is provided between the handle and the locking mechanism.

Further prior art disclosed in EP 1 225 290 B1 relates to a motor vehicle door lock with a pawl drive. The pawl drive uses a driven pulley to act upon a projection in order to release the rotary latch.

Finally, DE 695 11 357 T3 discloses an electrically operated lock in which the central locking function and an electric opening function can be provided by a common drive.

In the generic prior art disclosed in EP 1 320 652 B1, a mechanical connection between the external actuating lever, internal actuating lever and the locking mechanism is primarily provided as part of the emergency opening. In this way, a common "temporary redundancy" is realized as part of the emergency opening. As such an emergency opening is often associated with an accident or crash or occurs as a result thereof, this is also referred to in the industry as so-called "TCR" or "temporary crash redundancy". This arrangement has proven to be successful but can still be improved further in respect of safety aspects.

In the prior art mechanical coupling is actually provided by an intermediate lever controllable by the electric drive. This intermediate lever is provided between the external actuating lever and triggering lever interacting with the pawl. An additional locking function or a locking lever as such is not used.

The invention is based on the technical problem of further developing such a motor vehicle door latch so that the functional reliability of such a motor vehicle door lock is further increased compared to prior art.

In order to solve this technical problem a generic motor vehicle door lock of the invention is characterized in that the locking lever constantly retains its "locked" position during normal operation—also during electric opening.

The invention therefore first of all uses at least one locking lever. This locking lever already differs from the intermediate lever disclosed in EP 1 320 652 B1 as the intermediate lever ultimately couples the external actuating lever and the internal actuating lever to the triggering lever and works thus like a type of coupling lever.

In contrast, the locking lever of the invention works in such a way that its "locked" position, following the usual function, ensures that a mechanical actuation of a handle has no effect. Only when the handle in case of an internal actuation is being pulled twice, is a so-called "double-stroke" carried out and the locking lever can be moved into the "locked" position. This is, however, not mandatory but is owed to the generally required mechanical redundancy of electrically opened motor vehicle door locks.

After all, impinging upon the handle usually ensures that an associated signal generator is acted upon, which in turn initiates the control of the electric drive in the sense of "opening". This means that the handle is not mechanically connected to the locking mechanism—at least during normal operation. Instead, it is only the impinging upon the signal generator assigned to the handle that ensures that the locking mechanism is electrically opened. For this purpose, the electric drive normally acts upon a triggering lever, in turn lifting the pawl or one of several pawls of the rotary latch.

Opening of the locking mechanism normally requires that the locking lever has previously occupied its "locked" position. According to the invention, the locking lever does, however, constantly retain its "locked" position during normal operation and also during electric opening. This ensures that also in the event of an accident the locking lever still retains its "locked" position. As a result, any unintentional opening of the door is in any case prevented. Even if the handle is unintentionally acted upon as a result of the generated forces, the locking mechanism cannot open as the locking lever located or remaining in the "locked" position during normal operation, ensures the required mechanical interruption of the actuating lever chain from the handle up to the locking mechanism.

Only after switching from normal operation to emergency operation is the locking lever moved into the "unlocked" position by the electric drive. The handle is then able to mechanically open the locking mechanism. Again, a temporary mechanical redundancy is provided, typically applied immediately after an accident or a crash, as described above. This considerably enhances safety as the change from normal operation to emergency operation typically occurs after triggering of, for instance, an airbag sensor and after a time delay.

During the change from the normal to the emergency operation, the electric drive ensures that the locking lever assumes its "unlocked" position. This does, however, only occur after any safety-relevant sensors have been triggered, activating e.g. side airbags, steering wheel air bags, passenger air bags, a potential belt tightener, crash sensor, etc.

This means that the transition from normal operation to emergency operation is only carried out automatically with the aid of the electric drive, when all safety-relevant systems have been activated, ensuring and being able to ensure optimum passenger protection. Where in such a situation the electric supply of the drive is no longer ensured and it can therefore not automatically switch from the normal to the emergency operation in order to move the locking lever into its "unlocked" position, unlocking and a subsequent manual opening operation are still possible. Arriving emergency services can mechanically open the motor vehicle door lock after unlocking it from the inside. Using the "double-stroke actuation", passengers inside the car can unlock the lock during a first stroke and open the lock and door in a second stroke. These are the main advantages.

In order to achieve this in detail, the electric drive regularly contains a safety lock. The safety lock ensures that, in particular during electric opening, the locking lever is retained in its "locked" position. This means that the safety lock ensures that the mechanism is not unlocked when during normal operation an opening signal is generated through the internal actuating lever. The invention does, however, ensure that the locking lever assumes its "locked" position during electric opening as the function "electric opening" and "locking" share the same direction of rotation.

In order to achieve this in detail, the safety lock is designed as blocking contour cooperating with a projection on the locking lever. The safety lock or the blocking contour is generally located on a driven pulley of the electric drive.

The electric drive as such generally comprises at least an electric motor, driving a worm gear and a driven pulley meshing with the worm gear. In this way, the electric drive can define a first drive direction corresponding to the normal operation and a second drive direction associated with the emergency operation. Generally, the first drive direction corresponds to a counter-clockwise rotation of the driven pulley, whilst the second drive direction corresponds to a clockwise rotation of the driven pulley. The drive directions can, however, also be reversed.

The electric drive also typically contains an opening contour which cooperates with the triggering lever impinging upon the locking mechanism during electric opening. This opening contour can be an opening cam or similar.

The electric drive also contains a return spring. This return spring can be a centre/zero spring, advantageously integrated in the driven pulley. The return spring ensures that after being impinged on, the electric drive does and can assume a neutral position in the first or second drive direction.

Furthermore a blocking lever is provided, selectively cooperating with the electric drive. For this purpose, the electric drive also contains a recess advantageously located in the driven pulley—just like the opening contour.

Generally a signal generator is allocated to a blocking lever. This signal generator can be a signal generator interacting with the handle, as the blocking lever is regularly acted upon and deflected with the aid of the handle. As soon as the handle is being impinged upon not only the signal generator is activated but also the blocking lever is pivoted away from the electric drive. As a result, the blocking lever is able to absorb or block any incorrect energizing of the electric drive. Such incorrect energizing would result in the handle not being impinged upon. In this case, the blocking lever is also not impinged upon and is thus able to block the electric drive so that the locking mechanism does not open unintentionally.

As a result of the mechanical coupling of the blocking lever with the handle, situations can arise in which the handle and thus the blocking lever is impinged upon and during an already initiated electric opening process. In order to be able to still process such a scenario or repeat impinging upon the handle and thus of the blocking lever as well as of the signal generator in such a situation, said recess is provided on the electric drive or the respective driven pulley. A blocking projection of the blocking lever actually enters the respective recess in this scenario, so that the electric opening process, already initiated during the first actuation, is not affected. The signal generator is free and can process the signals.

Lastly, a stop is assigned to the electric drive and/or the locking lever. This stop can be a combined stop or an associated stop contour, designed for a cooperation with the electric drive and the locking lever. The stop or stop contour can typically be connected to a (plastic) door lock housing and can in turn be made of a thermoplastic material such as PUR (Polyurethane).

Below, the invention is explained in detail with reference to a drawing showing only one embodiment example, in which.

Figure 1:
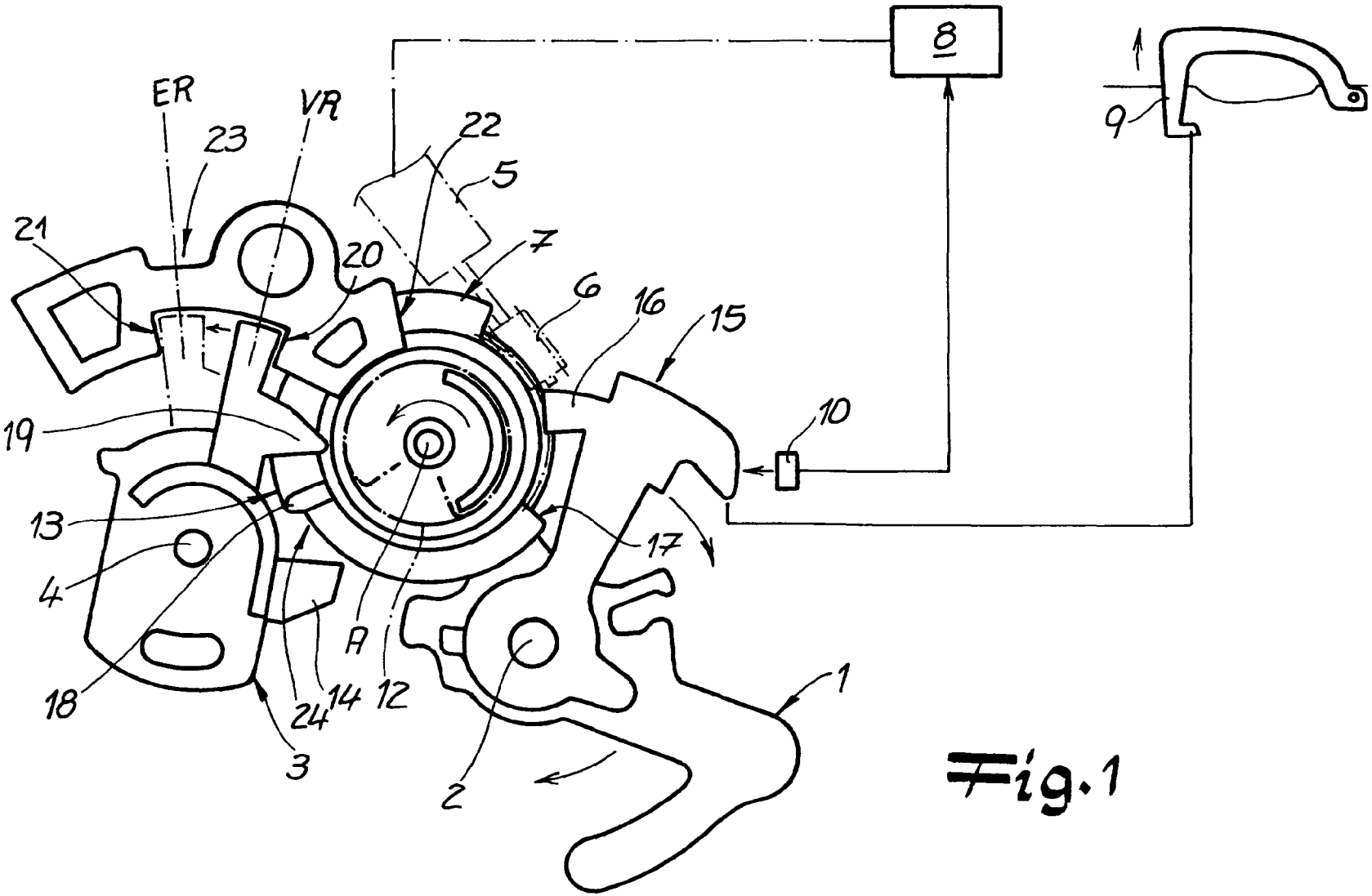
FIG. 1 shows a front view of the motor vehicle door lock of the invention.

The figures show a motor vehicle door lock containing a locking mechanism—not expressly shown. Indeed the locking mechanism comprises as usually a rotary latch and a pawl. The pawl is acted upon by a triggering lever 1 pivotally mounted in a lock housing or lock case around axis 2. As soon as the triggering lever 1 carries out or can carry out a clockwise rotary movement around its axis 2, as indicated in FIG. 1, the triggering lever 1 is able to lift the pawl of the rotary latch. The functionality is similar to that disclosed in more detail in EP 1 320 652 B1 as described above.

The figure also shows a locking lever 3, pivotally mounted around an axis 4. In the diagram shown in FIG. 1, the locking lever 3 assumes its "locked" (VR) position. FIG. 1 also shows the "unlocked" position (ER) of the locking lever 3.

Figure 2:
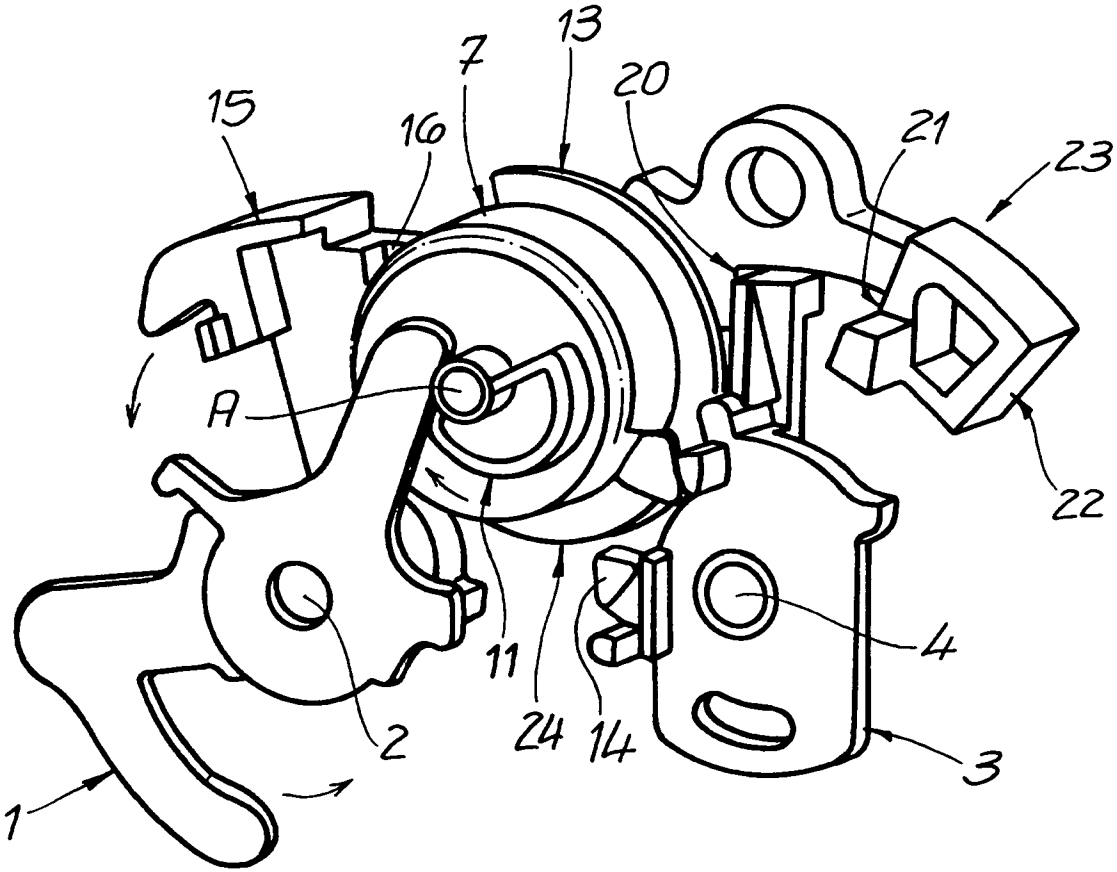
FIG. 2 shows a rear view of the object of FIG. 1.
Figure 3:
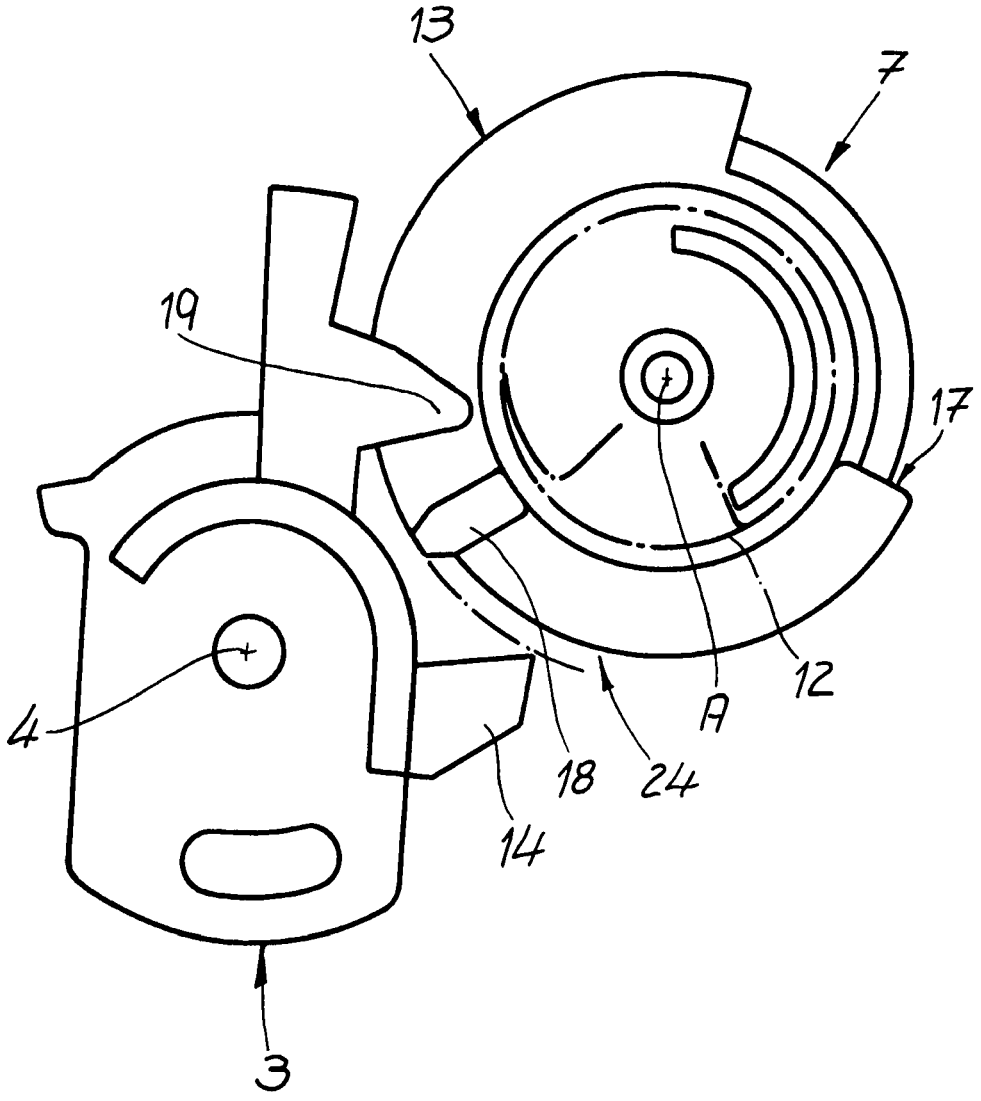
FIG. 3 shows an enlarged view of the driven pulley and the locking lever

The basic arrangement also includes an electric drive 5, 6 7. The electric drive 5, 6, 7 comprises an electric motor 5, a worm gear 6 impinging upon the electric motor 5 as well as a driven pulley 7, meshing with the worm gear 6. The driven pulley 7 is able to pivot around its axis A and, in relation to FIG. 1, in counter-clockwise direction of a first drive direction and in clockwise direction in accordance with a second drive direction In normal operation, a handle 9 together with a signal generator 10 ensure that the opening movements on the handle 9 are registered by the signal generator 10 and are transmitted to a control unit 8. The control unit 8 interprets a respective impinging on the signal generator 10 in such a way that an associated motor vehicle door is to be opened. The control unit 8 therefore ensures that the electric motor 5 is being energized and in such a way that the driven pulley 7 carries out a counter-clockwise movement as indicated by an arrow in FIG. 1. This counter-clockwise movement in the normal operation of the locking mechanism during electric opening with the aid of the electric drive 5, 6, 7 corresponds to the opening contour 11 or an opening cam 11 impinging upon the triggering lever 1 and pivoting it around its axis of rotation 2 in clockwise direction as indicated by an arrow. As a result, the triggering lever 1 ensures that the pawl is lifted off the rotary latch which in turn opens with the assistance of a spring (see FIGS. 1 and 2).

The opening contour 11 or the opening cam 11 is assigned to the electric drive 5, 6, 7. In the embodiment, the opening contour or the opening cam 11 is located on the driven pulley 7. An additional return spring 12 assigned to the electric drive 5, 6, 7 ensures that the electric drive 5, 6, 7 returns to a neutral position after being impinged upon by the triggering lever 1. For this purpose, said spring 12 is designed as a centre/zero spring in the embodiment and is integrated in the driven pulley 7.

During the described electric opening, a blocking contour 13 on the driven pulley 7 ensures that the locking lever 3 constantly retains the shown "locked" (VR) position and assumed in FIG. 1, as the blocking contour 13 cooperates with a projection 14 on the respective locking lever 3 during the described opening operation. In this way, the electric drive 5, 6, 7 or its driven pulley 7 is equipped with a safety lock which during electric opening of the locking lever 3 ensures, as described, that it is retained in its "locked" (VR) position. For this purpose, the safety lock or the said blocking contour 13 is provided at the driven pulley 7 as part of the electric drive 5, 6, 7.

The handle 9 not only impinges on the signal generator 10 but also on an additionally shown blocking lever 15. This blocking lever 15 is mounted on the same axis as the triggering lever 1 around the common axis 2. As soon as the handle 9 is impinged upon by an operator in the opening sense, the blocking lever 15 pivoted around the axis 2 in clockwise direction. As a result, the blocking projection 16 on the blocking lever 15 is detached from the electric drive 5, 6, 7 or its driven pulley 7.

If the handle 9 and thus the blocking lever 15 is, however, not acted upon, the blocking projection 16 remains engaged in the electric drive 5, 6, 7 and ensures in case of an incorrect energizing of the electric drive 5, 6, 7 that its carried out counter-clockwise movement is stopped, as during this process, a stop 17 moves against the respective blocking projection 16. The pivoting movement carried out by the driven pulley 7 until then is designed in such a way that such incorrect energizing does and cannot cause the locking mechanism to open. Also the stop 17 in connection with the blocking projection 16 on the blocking lever 15 ensures that the pivoting movement of the electric drive 5, 6, 7 for moving the locking lever 3 from its unlocked into its locked position, is restricted.

If the locking lever 3 is, for instance, in its "unlocked" (ER) position, as shown by the dashed lines in FIG. 1, impinging upon the electric drive 5, 6, 7 or upon its driven pulley 7 in counter-clockwise direction ensures that a locking contour 18 on the driven pulley 7 engages with the blocking projection 14 of the locking lever 3 pivoting it from the "unlocked" (ER) position around the axis 4 in clockwise direction into the "locked" (VR) position. The respective pivoting movement of the driven pulley 7 in counter-clockwise direction is restricted by the blocking stop 17 on the driven pulley 7 moving against the blocking projection 16 of the blocking lever 15.

When switching from the normal to the emergency operation, this emergency operation immediately ensures that the driven pulley 7 does not carry out a counter-clockwise movement (first drive direction) via the control unit 8 and the electric motor 5 but is instead impinged upon in clockwise direction. As a result, the locking or unlocking contour 18 an on the driven pulley 7 engages with an unlocking projection 19 on the locking lever 3 as the locking lever 3 is in its "locked" (VR) position. As the driven pulley 7 is pivoted clockwise around it axis A during this process, the interaction between the unlocking and locking projection 19 and the unlocking contour 18 ensures that the locking lever 3 is pivoted around its axis 4 in counter-clockwise direction. During this process, the locking lever 3 leaves the stop 20 and moves against stop 21. At the same time the locking lever 3 moves its position from "locked" (VR) to "unlocked" (ER).

Both stops 20, 21 are part of the stop contour 23, also containing a stop 22. This stop 22 is used as soon as the stop 17 of the electric drive 5, 6, 7 is moved against it during electric opening. This is possible as during electric opening, the blocking lever 15 is pivoted away with the aid of the handle 9 so that the stop 17 can move past the blocking lever 15 on the driven pulley 7.

It is also apparent that the driven pulley 7 contains a recess 24. This recess 24 ensures that during an already initiated opening process, a repeat actuation of the handle 9 or releasing or repeated impinging on the handle 9 by the signal generator 10 assigned to the blocking lever 15 can be processed.—The stop contour 23 may be made of plastic and connected to the motor vehicle door lock housing.

The invention claimed is:

1. A motor vehicle door lock comprising:

a triggering lever configured to operate a locking mechanism for opening the motor vehicle door lock;

at least one locking lever moveable between a locked position and an unlocked position; and an electric drive being operable in a normal operation in which the electric drive acts upon the trigger lever for electric opening of the locking mechanism, wherein the locking lever retains the locked position in the normal operation for electric opening; and the electric drive is operable in an emergency operation in which the electric drive acts on the locking lever to move the locking lever from the locked position to the unlocked position, thereby permitting opening motor vehicle door lock.

2. The motor vehicle door lock according to claim 1, wherein the electric drive contains a safety lock that interacts against the locking lever to maintain the locking lever in the locked position during electric opening.

3. The motor vehicle door lock according to claim 2, wherein the safety lock is a blocking contour on the electric drive cooperating with a projection on the locking lever.

4. The motor vehicle door lock according to claim 2, wherein the safety lock is provided on a driven pulley of the electric drive.

5. The motor vehicle door lock according to claim 1, wherein the electric drive comprises at least one electric motor, a worm gear driven by said motor and a driven pulley meshing with the worm gear.

6. The motor vehicle door lock according to claim 1, wherein the electric drive is operable in a first drive direction corresponding to the normal operation and a second drive direction corresponding to the emergency operation.

7. The motor vehicle door lock according to claim 6, wherein the electric drive comprises an electric motor that drives a driven pulley, and the first drive direction corresponds to a counter-clockwise rotation of the driven pulley and the second drive direction corresponds to a clockwise rotation of the driven pulley or vice versa.

8. The motor vehicle door lock according to claim 1, wherein the electric drive contains an opening contour cooperating with the triggering lever impinged upon by the locking mechanism during electric opening.

9. The motor vehicle door lock according to claim 8, wherein the electric drive comprises an electric motor that drives a driven pulley, and the opening contour is designed as opening cams provided on the driven pulley.

10. The motor vehicle door lock according to claim 1, wherein the electric drive comprises an electric motor that drives a driven pulley and a return spring mounted in the driven pulley to return the electric drive to a neutral position after acting on the trigger lever.

11. The motor vehicle door lock according to claim 1, further comprising a blocking lever selectively cooperating with the electric drive, wherein the blocking lever detaches from the electric drive during the normal operation and blocks operation of the electric drive from driving the trigger lever other than during the normal operation.

12. The motor vehicle door lock according to claim 11, wherein a signal generator is assigned to the blocking lever.

13. The motor vehicle door lock according to claim 11, further comprising a handle that is operable for actuating the normal operation, wherein the blocking lever is mechanically coupled to the handle.

14. The motor vehicle door lock according to claim 1, wherein a stop contour is assigned to the electric drive and/or the locking lever.

15. The motor vehicle door lock according to claim 14, wherein the stop contour contains a stop for the electric drive and at least one stop for the locking lever.

* * * * *